US011083241B2

(12) United States Patent
Polegato Moretti et al.

(10) Patent No.: US 11,083,241 B2
(45) Date of Patent: Aug. 10, 2021

(54) WATERPROOF AND BREATHABLE SHOE

(71) Applicant: GEOX S.p.A., Frazione Biadene (IT)

(72) Inventors: Mario Polegato Moretti, Crocetta del Mentello (IT); Livio Poloni, Caerano di San Marco (IT); Bruno Mattioni, Montebelluna (IT)

(73) Assignee: GEOX S.p.A., Frazione Biadene (IT)

( * ) Notice: Subject to any disclaimer, the term of this patent is extended or adjusted under 35 U.S.C. 154(b) by 113 days.

(21) Appl. No.: 15/749,939

(22) PCT Filed: Aug. 2, 2016

(86) PCT No.: PCT/EP2016/068455
§ 371 (c)(1),
(2) Date: Feb. 2, 2018

(87) PCT Pub. No.: WO2017/021418
PCT Pub. Date: Feb. 9, 2017

(65) Prior Publication Data

US 2018/0228246 A1 Aug. 16, 2018

(30) Foreign Application Priority Data

Aug. 3, 2015 (IT) ..... 102015000041242

(51) Int. Cl.
*A43B 7/12* (2006.01)
*A43B 23/02* (2006.01)

(52) U.S. Cl.
CPC ..... *A43B 7/125* (2013.01); *A43B 23/022* (2013.01); *A43B 23/0215* (2013.01)

(58) Field of Classification Search
CPC ..... A43B 23/22; A43B 23/0215
See application file for complete search history.

(56) References Cited

U.S. PATENT DOCUMENTS 4,493,870 A * 1/1985 Vrouenraets ..... B32B 27/12 442/236
4,599,810 A * 7/1986 Sacre ..... A43B 7/125 36/55

(Continued)

FOREIGN PATENT DOCUMENTS

AT 393 942 B 1/1992
DE 100 58 094 C1 5/2002

(Continued)

OTHER PUBLICATIONS

Priority Search Report dated Apr. 6, 2016 in Italian Patent Application No. ITUB20152773.

(Continued)

*Primary Examiner* — Jila M Mohandesi
(74) *Attorney, Agent, or Firm* — Oblon, McClelland, Maier & Neustadt, L.L.P.

(57) ABSTRACT

A waterproof and breathable shoe that includes an upper assembly that wraps around a foot insertion region and associated, in its plantar region, with an outsole; the upper assembly has a first portion that is structured like an upper and a second portion, substantially a structural insert, that is structured like an assembly insole for the first portion and is extended at least at the forefoot; the first portion has at least one waterproof portion that is composed at least partly of a waterproof and breathable functional element that has a one piece structure made of polymeric material that is impermeable to water and permeable to water vapor, constituting for the first portion the structural layer of the upper of the waterproof and breathable shoe, at least one functional portion of the functional element having a thickness to give it a penetration resistance of more than approximately 10 N.

15 Claims, 4 Drawing Sheets

(56) References Cited

U.S. PATENT DOCUMENTS

| | | | | |
|---|---|---|---|---|
| 4,899,465 | A * | 2/1990 | Bleimhofer | A43B 1/0072 36/14 |
| 5,426,869 | A * | 6/1995 | Gore | A43B 7/125 12/142 T |
| 6,845,572 | B1 * | 1/2005 | Haimerl | A43B 7/12 36/12 |
| 8,356,425 | B2 * | 1/2013 | Polegato Moretti | A43B 7/08 36/3 B |
| 2004/0181968 | A1 * | 9/2004 | Haugland | A43B 3/24 36/4 |
| 2005/0210708 | A1 * | 9/2005 | Chen | A43B 7/125 36/55 |
| 2010/0041295 | A1 | 2/2010 | Malz et al. | |
| 2010/0180474 | A1 | 7/2010 | Clark et al. | |
| 2012/0151805 | A1 * | 6/2012 | Polegato Moretti | A43B 7/06 36/25 R |
| 2012/0151806 | A1 * | 6/2012 | Polegato Moretti | A43B 7/06 36/3 B |
| 2014/0128684 | A1 | 5/2014 | Carlson | |

FOREIGN PATENT DOCUMENTS

| | | | | |
|---|---|---|---|---|
| DE | 10 2008 029 296 | A1 | 12/2009 | |
| EP | 0 714 612 | A1 | 6/1996 | |
| EP | 0689500 | B1 | 10/1996 | |
| EP | 1457126 | A1 * | 9/2004 | A43B 9/02 |
| EP | 2 298 100 | A1 | 3/2011 | |
| EP | 2 742 820 | A1 | 6/2014 | |
| JP | 62-22603 | A | 1/1987 | |
| JP | 2013-502946 | A | 1/2013 | |
| JP | 2013-502947 | A | 1/2013 | |
| JP | 2013-536708 | A | 9/2013 | |
| JP | 2013-542820 | A | 11/2013 | |
| JP | 2014-521417 | A | 8/2014 | |
| TW | 201330794 | A1 | 8/2013 | |
| WO | WO 94/21453 | A1 | 9/1994 | |
| WO | WO 2011/023507 | A1 | 3/2011 | |
| WO | WO 2011/023509 | A1 | 3/2011 | |
| WO | WO 2012/041637 | A1 | 4/2012 | |

OTHER PUBLICATIONS

International Search Report dated Oct. 5, 2016 in PCT/EP2016/068455 filed Aug. 2, 2016.

European Office Action dated Mar. 17, 2020, in Patent Application No. 16745488.3, 118 pages.

Combined Chinese Office Action and Search Report dated Mar. 11, 2020 in Chinese Patent Application No. 201680045585.6 (submitting English translation only), 9 pages.

Combined Taiwanese Office Action and Search Report dated Mar. 9, 2020 in Taiwanese Patent Application No. 105124668 (with English translation of Search Report), 4 pages.

Notice of Reasons for Refusal dated Jul. 21, 2020 in Japanese Patent Application No. 2018-505657 (with English summary and English language translation), 16 pages.

Office Action dated Mar. 9, 2021 in corresponding Japanese Patent Application No. 2018-505657 (with English Translation), 6 pages.

* cited by examiner

WATERPROOF AND BREATHABLE SHOE

The present invention relates to a waterproof and breathable shoe.

Currently it is known that a shoe, in order to be comfortable, in addition to anatomically fitting properties, must ensure a correct exchange of heat and water vapor between the microclimate inside the shoe and the external microclimate, which coincides with the ability to dissipate outward the water vapor that forms due to the perspiration of the foot.

The part of the foot that is usually most subject to sweating is the sole. The sweat saturates the internal environment of the shoe and mostly condenses, stagnating on the insole.

Shoes are known which solve the problem of internal perspiration by using a perforated elastomer outsole on which a membrane that is permeable to water vapor and impermeable to water is sealed so as to cover its through openings.

However, in order to ensure good heat exchange between the internal microclimate and the external one, permeability to water vapor and impermeableness to water must be ensured not only at the outsole but substantially for the entire shoe.

The exchange of heat and water vapor must not compromise the impermeableness of the shoe to external humidity and water or vice versa. However, breathable shoes are traditionally the ones that use natural materials such as leather or equivalent products, which however, in the presence of rain, easily absorb water, which can also penetrate through the stitched seams used for assembly.

For this reason, waterproof shoes have been widely commercially available for some time, in which the external material of the upper is coupled to a lining that is laminated with a waterproof and breathable membrane.

The waterproof and breathable membranes that are usually used to provide these shoes are for example of the type described in some patents in the name of W. L. Gore or in the name of BHA Technologies.

They are constituted by thin films made of expanded polytetrafluoroethylene, e-PTFE, with thicknesses that usually vary from 15 to 70 microns and are waterproof and breathable.

Their microstructure is characterized by the presence of dense areas, known as nodes, which are interconnected by elongated filaments, known as fibrils.

Since the clothing and footwear market requires soft and comfortable items, the need is felt to ensure that the membrane does not compromise these characteristics thereof.

For this reason, the use of thin membranes to be laminated with supporting and/or aesthetic finishing materials, such as fabric or leather, has become widespread so as to obtain laminated products that have characteristics of flexibility, easy bending, softness, surface slipperiness, compressibility and stretchability and low weight per unit surface.

However, indeed due to their reduced thickness, these membranes have limited mechanical strength characteristics. In particular, membranes with a thickness comprised in the above-cited range have a penetration resistance of less than 5 N, where the expression "penetration resistance" is understood to reference the characteristic defined by a measurement taken according to the methodology presented in the ISO 20344-2004 standard, in chapter 5.8.2, "Determination of the penetration resistance of the outsole", which relates to safety shoes.

Furthermore, such membranes also have a tear strength of less than 5 N, where the expression "tear strength" is understood to reference the characteristic defined by a measurement taken according to the methodology presented in the EN 13571:2001 standard, and a tensile strength of less than 15 MPa, where the expression "tensile strength" is understood to reference the characteristic defined by a measurement taken according to the methodology presented in the EN 12803:2000 standard.

In fact, the resistance value of the laminated arises mainly from the characteristics of the structural layer of fabric or leather to which the membrane is coupled.

The expression "structural layer" is understood to reference a layer that is capable of withstanding the piercing, tensile and tear stresses and the flexural and stretching deformations caused by the external stresses applied to an upper during use of the shoe.

In the production of shoes with a waterproof and breathable membrane, the need is also particularly felt to obtain an effective seal of the joining regions between the insole, the membrane, the outer layer of the upper and the outsole, in order to avoid even the slightest infiltration of water from outside.

Currently it is known that even when the upper assembly has a waterproof and breathable membrane interposed between the outer layer and the inner lining there is a substantially total lack of waterproofness, since the outer layer of the upper and the inner lining are not usually made of waterproof material and water is free to infiltrate and move by capillary action within said layers.

Moreover, this overlap of layers inevitably generates a substantial reduction in the original vapor permeability both of the individual external material of the upper and of the individual membrane.

So far, some solutions to these drawbacks are known.

Among these, the one disclosed in document USRE34890, which consists in using a lining, constituted by a fabric coupled to a waterproof and breathable membrane that is closed like a sock, so as to fully wrap around the foot.

The lining thus built prevents water from penetrating within the shoe and at the same time allows outward vapor permeation.

Also according to the same disclosed solution, an insole is applied to the bottom of the sock-like lining and the assembly margins of the outer layer of the upper are folded and sewn perimetrically thereon.

The sock-like lining has a foot insertion opening and is provided by association of two lateral portions and of a lower portion and the parts are joined by stitched seams of the zigzag and/or strobel type, which are sealed by means of a waterproof sealing tape.

The outsole is then assembled by adhesive bonding or by direct injection on the upper.

This solution is not devoid of drawbacks, which are mainly due to the complexity of the production process.

The provision of the sock-like lining requires considerable attention in cutting the model, in order to ensure that the membrane does not break during assembly, a very precise stitching of the parts, in order to avoid spaces or protrusions that would prevent sealing, and the use of special machines for sealing the stitched seams.

Furthermore, also in the production of the sock-like lining, it is difficult to achieve a precise shaping thereof by means of stitched seams and not by lasting, both due to the difficulty in preparing the various portions that must be cut and sewn together with accurate precision and due to the difficulty in achieving a correct tension between the external material of the upper and the lining so that creases are not formed. In fact, indeed because the last is not used during the sewing of the lining, said lining tends to wrinkle during pre-assembly of the upper.

Moreover, a shoe thus provided does not appear to fully obviate the drawbacks described above, since it allows water to penetrate through the external material of the upper, generating a retention of water between the waterproofed lining and the internal surface of the upper. The stagnation of liquids generates an unpleasant feeling of dampness and causes a consequent increase in the weight of the shoe, inevitably reducing comfort for the user. Moreover, the shoe may thus require a considerable time to dry.

Another proposed solution is the one disclosed in EP0275644, according to which an upper, shaped like a sock that encloses the foot of the user, is formed by a waterproof and breathable fabric and is attached, with the interposition of a metallic mesh or other porous layer of protective material, to an outsole provided with openings that are permeable to air. From what has been described, it would appear that the upper is constituted exclusively by a waterproof and breathable thin film made of e-PTFE.

A thin film has such characteristics that without joining to adequate layers of fabric or leather it cannot be used as a structural layer of an upper for shoes.

Instead, an upper made of a laminated material, constituted by a thin film associated with internal structural materials for support and external aesthetic finishing materials, such as fabric or leather, would have to deal with the same drawbacks noted for the solution proposed in document USRE34890.

Another solution is the one disclosed in document EP2298100, by the same Applicant, which discloses a breathable shoe with an outsole that is resistant to penetration and tearing at least as much as the previously known perforated outsoles and at the same time at least equally effectively waterproof but allows greater vapor permeation. This shoe comprises an upper assembly that wraps around the foot insertion region and is associated in the plantar region with an outsole that has at least one breathable or perforated portion. The upper assembly has a structural insert, which is preferably structured like an insole, with a waterproof portion that is sealed in a waterproof manner to the perforated outsole so as to prevent the infiltration of liquid toward the foot insertion region. The waterproof portion is composed at least partly of a waterproof and breathable functional element that has a monolithic sheet-like structure made of polymeric material that is impermeable to water in the liquid state and permeable to water vapor. At least one functional portion of the functional element has such a thickness as to give it a penetration resistance of more than approximately 10 N, assessed according to the methodology presented in chapter 5.8.2 of the ISO 20344-2004 standard. The described functional element is capable of withstanding impacts and penetration on the part of foreign objects that might penetrate through the openings of the outsole and is capable of supporting the foot of the user so as to limit the forming of hollows in the foot insertion region at the openings of the outsole.

However, even this solution does not appear capable of obviating all the drawbacks described above and is also structurally complicated.

The aim of the present invention is to provide a totally waterproof and breathable shoe that obviates the drawbacks described above of currently known waterproof and breathable shoes, preventing the infiltration of water in the foot insertion region and being also structurally simpler.

Within this aim, an object of the invention is to provide a shoe that is totally waterproof and breathable, capable of dissipating larger quantities of water vapor than currently known waterproof and breathable shoes.

Another object of the invention is to provide a shoe that is fully and durably waterproof and breathable both through its upper and through its outsole, and equally effectively in the joining regions of its portions.

A further object of the invention is to provide a breathable shoe that is lighter than currently known breathable shoes and is equally sturdy.

Another object of the invention is to propose a shoe that is totally waterproof and breathable, is comfortable to use and can be manufactured with relatively low costs.

This aim, as well as these and other objects that will become better apparent hereinafter, are achieved by a waterproof and breathable shoe, comprising an upper assembly that wraps around the foot insertion region and is associated, in its plantar region, with an outsole, said shoe being characterized in that:

said upper assembly has a first portion that is structured like an upper and a second portion, substantially a structural insert, that is structured like an assembly insole for said first portion and is extended at least at the forefoot, said first portion has at least one waterproof portion that is composed at least partly of a waterproof and breathable functional element that has a monolithic sheet-like structure made of polymeric material that is impermeable to water and permeable to water vapor, constituting for said first portion the structural layer of the upper of said waterproof and breathable shoe, at least one functional portion of said functional element having such a thickness as to give it a penetration resistance of more than approximately 10 N, assessed according to the methodology presented in chapter 5.8.2 of the ISO 20344-2004 standard.

Further characteristics and advantages of the invention will become better apparent from the description of preferred but not exclusive embodiments of the waterproof and breathable shoe according to the invention, illustrated by way of nonlimiting example in the accompanying drawings, wherein.

It should be noted that anything that is found to be already known during the patenting process is understood not to be claimed and to be the subject of a disclaimer.

Figure 1:
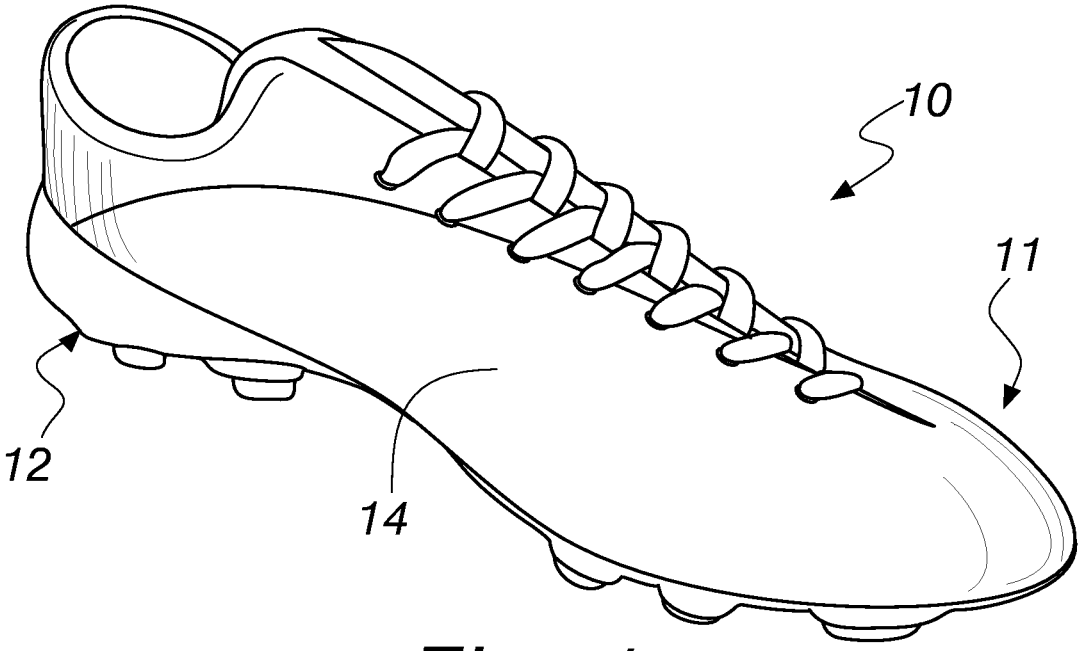
FIG. 1 is a view of a waterproof and breathable shoe according to the invention.
Figure 2:
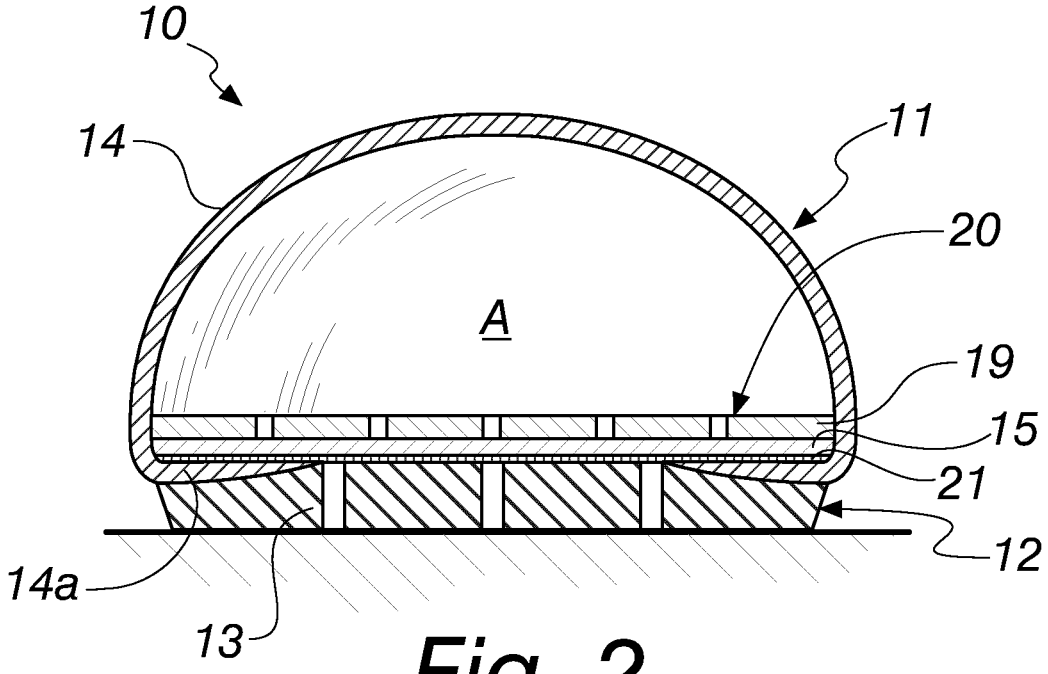
FIG. 2 and FIG. 3 are transverse sectional views of two variations of a waterproof and breathable shoe according to the invention.
Figure 3:
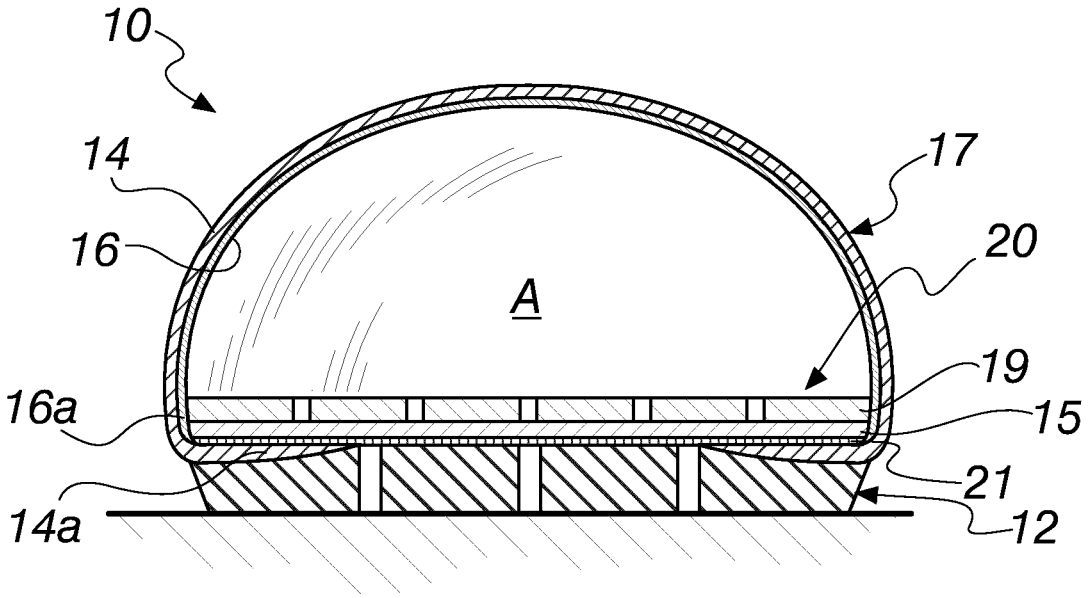

With reference to the figures, the reference numeral 10 generally designates the waterproof and breathable shoe according to the invention, which comprises an upper assembly 11 that wraps around the foot insertion region A, shown in FIG. 2 and in FIG. 3.

The upper assembly 11 is associated, in its plantar region, with an outsole 12 that preferably has at least one breathable or perforated portion 13.

According to the invention, the waterproof and breathable shoe 10 has a particularity in the combination of the characteristics described hereinafter.

Figure 4:
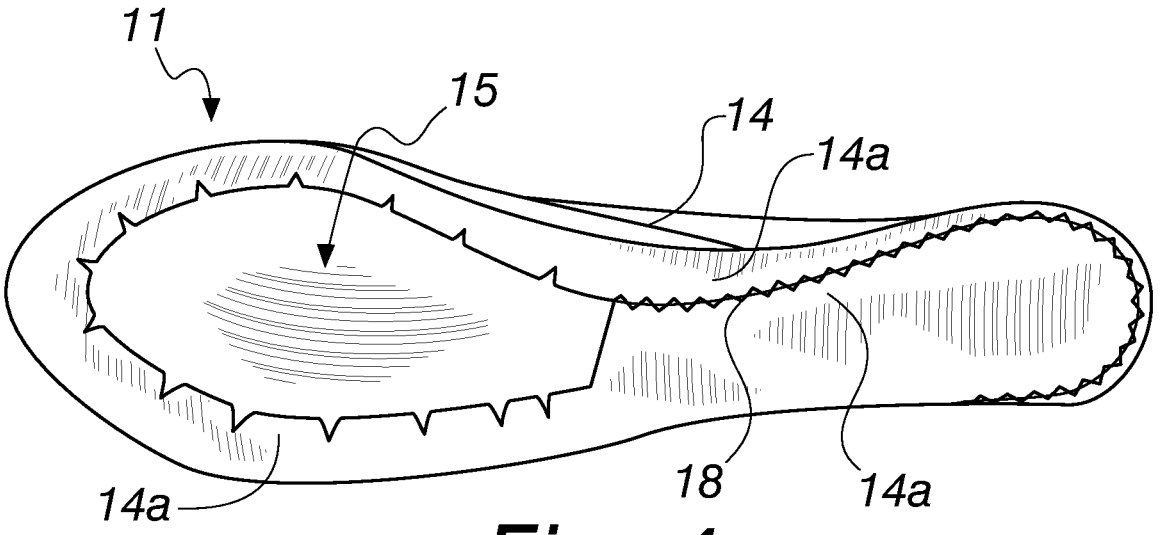
FIG. 4 and FIG. 5 are respectively a bottom view and a perspective view of an upper assembly.

The upper assembly 11 has a first portion 14 that is structured like an upper and a second portion 15, substantially a structural insert that is structured like an assembly insole for the first portion 14 and is extended at least at the forefoot, as shown in the example of FIG. 4.

The first portion 14 and the second portion 15 have at least one waterproof portion that is composed at least partly of a waterproof and breathable functional element that has a monolithic sheet-like structure made of polymeric material that is impermeable to water and permeable to water vapor, at least one functional portion of the functional element having such a thickness as to give it a penetration resistance of more than approximately 10 N, assessed according to the methodology presented in chapter 5.8.2 of the ISO 20344-2004 standard. The functional element constitutes for the first portion 14 the structural layer of the upper of the waterproof and breathable shoe 10.

The functional portion of the functional element of the second portion 15 covers the breathable or perforated portion 13 of the outsole 12.

The two portions are sealed in a waterproof manner, so as to prevent the infiltration of liquid toward the foot insertion region A and so as to constitute a completely waterproof and breathable upper assembly.

The test methodology presented in chapter 5.8.2 of the ISO 20344-2004 standard consists in providing a specimen of the material to be measured and subjecting it to penetration by a nail with a diameter of 4.50±0.05 mm, with a truncated tip and with the indicated shape and proportions. The tip of the nail has a minimum hardness of 60 HRC. The penetration speed of the nail is set at 10±3 mm/min until the tip has fully penetrated the specimen. The maximum force value measured, expressed in Newton, N, as a result of the penetration of the material is recorded. The test is performed on four specimens and the lowest of the four recorded values is assigned as the penetration resistance value of the tested material.

The expression "sheet-like", mentioned earlier, is understood as the shape characteristic of a structure that has one dimension that is greatly reduced with respect to the other two, such dimension being its thickness, which in any case, according to what is commonly understood to distinguish a sheet from a lamina or a membrane, remains significant.

However, it should not be understood that this shape characteristic in itself compromises the ability of the insert to bend or its flexibility.

In particular, the thickness of the functional portion of the functional element is comprised substantially between 0.1 mm and 3 mm and is preferably uniform.

Advantageously, the monolithic structure is layered and cohesive, comprising a plurality of functional layers made of polymeric material, which are impermeable to water in the liquid state and permeable to water vapor.

Furthermore, the functional element conveniently comprises at least one auxiliary layer that is permeable to water vapor and is interposed between the functional layers.

In particular, the auxiliary layers conveniently are made of material that is structured in fibers according to a fabric-like or nonwoven fabric-like configuration.

Preferably, such polymeric material is chosen among expanded polytetrafluoroethylene, e-PTFE, polyurethane, PU, polyethylene, PE, polypropylene, PP, polyester and the like.

More particularly, the functional element made of e-PTFE can be provided for example by means of a production process that consists of the following steps:

a step of extrusion in paste form, a stratification step, an expansion step, a sintering step.

In an alternative manner, the stratification step occurs before or after the expansion step, depending on the process used to join the plurality of functional layers that are impermeable to water in the liquid state and permeable to water vapor.

The expansion step consists in pulling a tape made of PTFE at least in a longitudinal direction.

This expansion increases the porosity of the material, further increasing its strength and orienting the fibrils in the traction direction.

After longitudinal expansion, the tape can be expanded also in a transverse direction, keeping it at a temperature comprised for example in the interval between 40° C. and 100° C., in order to increase its porosity further.

Thicknesses comprised between 0.1 mm and 3 mm give the functional element an abrasion resistance of more than approximately 51,200 cycles, determined according to the methodology presented in the EN13520 standard.

According to this standard, abrasion resistance, understood as surface resistance exhibited by a specimen of an upper, lining or insole when rubbed against an abrasive fabric, is assessed with a Martindale machine.

A specimen of material to be examined is rubbed against a reference abrasive fabric subjected to a constant pressure.

The relative motion between the abrasive fabric and the specimen is a complex cyclic pattern (a Lissajous figure), which produces rubbing in all directions by using sixteen elliptical movements (cycles) of the specimen holder.

The test is interrupted after a preset number of cycles and the damage affecting the specimen is assessed.

The abrasive fabric is a crossbred worsted spun, plain woven fabric with a minimum mass per unit surface of 195±5 $g/m^2$.

The specimen has a circular shape, with such a surface as to be contained firmly in the adapted supports, leaving exposed a circular flat portion of the surface of 645±5 $mm^2$.

The test is performed on four specimens and at the end abrasion, peeling and discoloring effects are recorded, classifying them according to one of the following descriptions: absent, very slight, slight, moderate, severe, almost full, or if a hole has been produced in the specimen.

Furthermore, at least one functional portion of the functional element has a tensile strength of more than approximately 20 MPa, assessed according to the methodology presented in the EN12803:2000 standard.

According to this standard, at least three specimens are required which are appropriately taken and conditioned and then inserted on the damps of an extensometer (preferably provided with a graphic recorder of tension and deformation), the separation speed of which is constant and equal to 100±10 mm/min. Ultimate tensile strength, expressed in MPa, is given by the average on the specimens used of the ratio between the force recorded at failure, in newtons, and the area of the narrowest cross-section of the specimen, in $mm^2$.

As mentioned, the functional element is waterproof and breathable. The expression "waterproof and breathable" usually is to be understood as the characteristic of a material of being impermeable to water in the liquid state combined with permeability to water vapor.

In particular, impermeableness to water is due to the absence of crossing points when the material is subjected to a pressure of at least 1 bar, held for at least 30 seconds.

More particularly, waterproofness is assessed as the resistance of the specimen to the penetration of water under pressure according to the methods described in the EN1734 standard.

According to this method, a specimen of material is fixed so as to close a vessel provided with a pressurized water inlet. The vessel is filled with water so as to subject the face of the specimen of material directed into the container to a hydrostatic pressure of 1 bar. This condition is maintained for 30 seconds.

The specimen is locked between the opening port of the vessel and a retention ring, both of which are covered with sealing gaskets made of silicone rubber.

Pressurization is achieved by forcing into the vessel water that arrives from a tank, by means of a stream of compressed air. This air is adjusted by a valve with a pressure gauge on which the pressure reached is shown.

The face of the specimen that is external to the vessel is then observed.

The absence of crossing points, which consists in the forming of drops with a diameter comprised between 1 mm and 1.5 mm on such surface, indicates the waterproofness of the specimen.

If it is necessary in order to avoid the deformation of the specimen, a grid is fixed thereon which has a square mesh with a side of no more than 30 mm, is made of synthetic material and provided by means of filaments with a diameter comprised between 1 mm and 1.2 mm.

The functional element conveniently has a water vapor permeability that is at least equal to 9 $mg/cm^2h$. The expression "water vapor permeability" is understood as the quantity of vapor that passes through a material due to a partial pressure gradient.

The ISO 20344-2004 standard, in chapter 6.6, "Determination of water vapor permeability", related to safety shoes, describes a testing method that consists in fixing a specimen of the material being tested so as to close the opening of a bottle that contains a certain quantity of solid desiccant, i.e., silica gel.

The bottle is subjected to an intense air stream in conditioned atmosphere.

The bottle is made to rotate so as to stir the solid desiccant and optimize its drying of the air contained in the bottle.

The bottle is weighed before and after the testing period in order to determine the mass of humidity that has passed through the material and has been absorbed by the solid desiccant.

The permeability to water vapor, expressed in milligrams per square centimeter per hour [$mg/cm^2/h$], is then calculated on the basis of the mass of humidity measured, of the area of the opening of the bottle and of the test time.

At least one functional portion of the functional element conveniently has, further, a tear resistance at least equal to 10 N, determined according to the methodology presented in the EN13571:2001 standard. The tear resistance, understood as the average force required to propagate a tear in a specimen, is measured by means of an adjustable dynamometer, which acts on the specimen at a constant speed of the crossmember of 100 mm/min. Six specimens of the material being considered are tested, three of which have a notch that is parallel to the longitudinal direction, also known as CAL and defined as the direction of extrusion of the material, and three of which have a notch in the transverse direction, also known as PAL, which is perpendicular to the longitudinal direction.

The specimen, which has the characteristic trousers-like shape, is arranged flat between the clamps of the dynamometer, so that the notch is perpendicular to the direction of traction, and is subjected to traction until it tears.

The value of the traction force in relation to the displacement is recorded and charted.

The tear resistance, expressed in newtons, is calculated as the arithmetic mean of the two arithmetic means TSCAL and TSPAL respectively of the traction forces recorded in the CAL and PAL tests.

The waterproof and breathable shoe 10 according to the invention is shown in FIGS. 2 and 3 in a transverse sectional view taken at the forefoot.

The two figures show two possible variations of a waterproof and breathable shoe 10, the uppers of which differ due to the presence of an upper lining 16.

In the first case, of FIG. 2, which represents the preferred solution, the upper is provided exclusively by means of a layer of the first portion 14, which is constituted entirely by the waterproof and breathable functional element. Therefore, the functional element constitutes the upper of the shoe 10.

In the second case, of FIG. 3, a breathable upper lining 16 is coupled to the first portion 14 structured like an upper and is arranged so as to line said first portion 14 inside the foot insertion region A, forming an upper assembly 17 of the waterproof and breathable shoe 10.

The upper lining 16 is advantageously associated with the first portion 14 by spot gluing and/or by means of stitched seams, so as to not compromise substantially its waterproofness and breathability.

For both solutions the lower edge 14*a* of the first portion 14 constitutes the assembly margin folded under the second portion 15, according to the construction known as "AGO lasting", optionally avoiding the roughing operation in order to preserve the functional element of the first portion 14.

In particular in the second case, as clearly visible, the lower edge 14*a* protrudes from the lower flap 16*a* of the upper lining 16, forming the assembly margin.

According to the requirements, the first portion 14 can be provided with a reinforcement mesh, preferably made of nylon, which covers its face directed toward the foot insertion region A and constitutes with it a one piece assembly, being bonded thereto by spot gluing.

The first portion 14 may further comprise an external mesh, which constitutes the outer layer of the upper, while the structural element of the upper remains the waterproof and breathable functional element.

The functional element has a tear resistance such that the first portion 14 has an adequate strength of the stitched seams 18 that join the various parts that constitutes the upper of the shoe, such as the vamp, the tongue and the quarters, provided by die-cutting from a sheet or roll of functional element.

The stitched seams 18 are conveniently waterproofed, on the side directed toward the foot insertion region A, by means of a thermal adhesive waterproof tape, which, during the assembly of the first portion 14, is exposed to heat and subjected to pressing, adhering to the functional element and sealing it at the stitched seam.

As an alternative, the stitched seams 18 can be conveniently waterproofed on the side directed toward the outside of the shoe by means of inserts made of a material that is impermeable to water, by high-frequency welding or by sealing adhesive bonding.

According to an alternative version, at upper portions that are already waterproof it is possible to avoid the use of the functional element, ensuring however a waterproof seal between the functional element and the waterproof materials such as, for example, an overlap and a sealing of the two for approximately 5÷10 mm or a stitched seam that is waterproofed by a tape that is impermeable to water.

Figure 5:
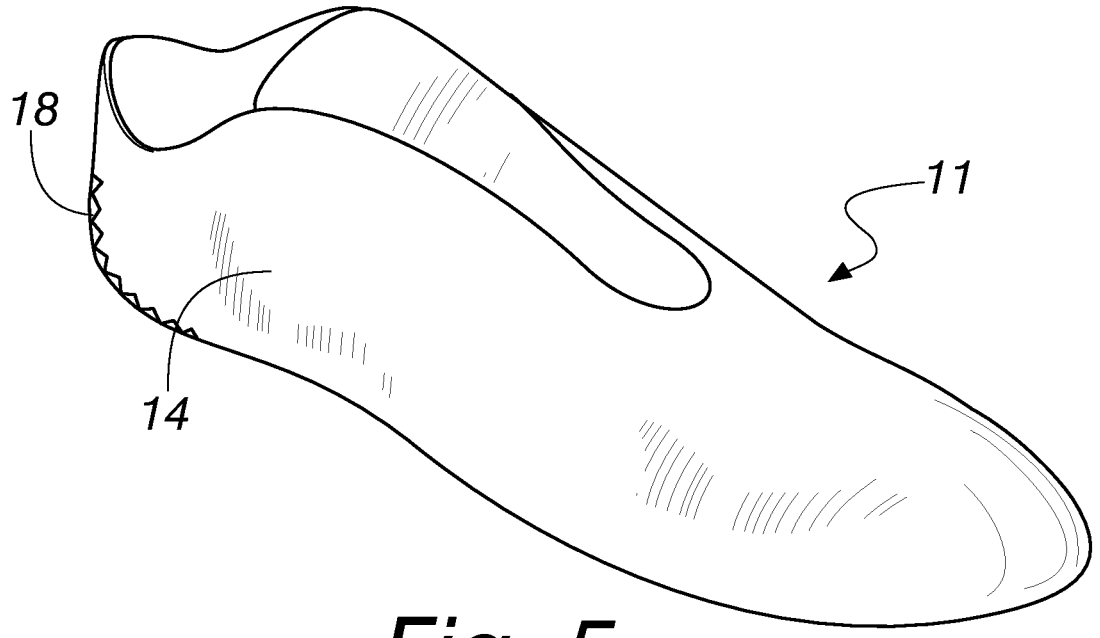

FIG. 4 and FIG. 5 show an example of upper assembly 11 according to the invention respectively in a bottom view, which clearly shows also the second portion 15 on which the lower edges 14*a* of the first portion 14 are folded and glued at the forefoot and the stitched seams 18, in particular a stitched seam 18 that joins two lower edges 14*a* that are folded and sewn below and perimetrically with respect to the outsole.

In order to reinforce the toe of the shoe it is possible to apply to the upper a toe cap made of waterproof material, for example by spot gluing, is especially if such material is breathable or perforated, so as to ensure its vapor permeation.

If the toe cap consists of an insert to be applied outside the upper, there is no need to use part of the functional element in overlap on such waterproof toe cap, as long as a waterproof seal is ensured, for example by superimposing and sealing bonding with adhesive the two materials for approximately 5÷10 mm or a stitched seam waterproofed by a tape that is impermeable to water.

As an alternative, the toe cap can be provided by molding plastic material on a support constituted by the functional element, optionally before it is shaped in order to provide the upper.

If the toe cap is applied inside the upper, then the presence of the waterproof and breathable functional element at the toe cap is necessary.

Likewise, it is possible to apply a rear counter.

The first portion 14 can also be colored by introducing coloring materials at the time of the extrusion in paste form of the functional element or can be decorated by applying decorative elements made of polymeric material, chosen preferably among polyurethane, polyvinyl chloride or the like. The decorative elements are conveniently joined to the functional element by high-frequency welding or by screen printing or by adhesive bonding. As an alternative, they can be molded in plastic material directly on the functional element, optionally before it is shaped to constitute the upper.

The second portion 15, i.e., the structural insert that is structured like an assembly insole, is also preferably constituted entirely by the functional element. Therefore, in this case also, the waterproof portion coincides with the entirety of the second portion 15, provided by die-cutting from a sheet or roll of waterproof and breathable functional element.

Optionally, the second portion 15 can be conveniently reinforced at the outsole, at the plantar arch and at the heel with a shank made of material chosen among leather, plastic material and metallic material in order to provide greater support and torsion resistance of the shoe.

In an alternative solution, the second portion 15 structured like an assembly insole comprises at least one waterproof and breathable portion that is constituted at least partly by the functional element and at least one other waterproof portion made of a material chosen among polyurethane or polyethylene or polyvinyl chloride or the like. The second portion 15 can be reinforced at the plantar arch and at the heel by means of a shank made of a material chosen among leather, plastic material and metallic material. According to this solution, the functional element of the waterproof portion constitutes the part of the second portion 15 at the forefoot and is joined, by waterproof sealing adhesive bonding or by way of waterproofed stitched seams, to the remaining portion.

In any case, thanks to the tear resistance of the functional element, the second portion also is capable of allowing an adequate seal of the stitched seams.

In another and preferable solution, the second portion 15 is coupled to a breathable or perforated reinforcement layer 19 made of perforated rigid polymeric material or felt or fabric, which covers the face thereof that is directed toward the foot insertion region A, as shown in the figures in transverse cross-section. The breathable or perforated reinforcement layer 19 is joined by spot gluing, or by means of a high-frequency process or co-molding, to the second portion 15, so as to not compromise its breathability and forming with it a lower assembly 20.

Furthermore, the second portion 15 is also advantageously provided with a mesh 21, which also is clearly visible in the figures in transverse cross-section and covers the face thereof that is directed toward the outsole 12 so as to form with it and with the breathable or perforated reinforcement layer 19 the lower assembly 20.

According to a possible assembly of the first portion 14 with the second portion 15, the former, which is structured like an upper, can be joined perimetrically to the latter, which is structured like an assembly insole, with the lower edge 14*a*. Such edge is in fact folded and glued so as to provide a seal according to the construction known as "AGO lasting" under the perimetric edge of the second portion 15, so as to form a waterproof and breathable upper assembly 11 that wraps around the foot insertion region A, to which the outsole 12 is joined by adhesive bonding or by direct injection on the upper.

The sealing joint between the first portion 14 and the second portion 15, at the assembly margin, is provided by means of an adhesive of the polyurethane type.

In order to further strengthen the assembly margin, constituted by the lower edge 14*a* of the first portion 14, therefore at the joining region between the first portion 14 and the second portion 15, it is possible to apply directly thereto a waterproof reinforcement element, for example a preferably elastic waterproof thermal adhesive tape made of synthetic material (not shown).

As an alternative, the first portion 14 can be associated at its end by means of a stitched seam, preferably of the strobel type, with the perimetric s edge of the second portion 15 structured like an assembly insole.

Thanks to the tear strength of the functional element, the first portion 14 and the second portion 15 are capable of ensuring an adequate seal of the stitched seams on their respective edges.

The stitched seam of the strobel type is conveniently waterproofed by means of a waterproof thermal adhesive tape, which in application is subjected to heat and pressing, adhering to the portions at the stitched seams, so as to form a waterproof and breathable upper assembly that wraps around the foot insertion region A, to which the outsole 12 is joined by adhesive bonding or by direct injection on the upper.

As an alternative, the seals of the upper assembly 11 can be performed by using adhesives and sealants such as for example silicone and polyurethane adhesives, films made of high-melting thermoplastic adhesive or high-melting sealants.

According to another possible embodiment of the upper assembly 11, the one shown in FIG. 4, the lower edge 14*a* of the first portion 14, at the forefoot, is joined perimetrically and hermetically to the second portion 15. In particular, at the forefoot the lower edge 14*a* is folded and glued so as to provide a seal, at least predominantly according to the construction known as "AGO lasting", under the perimetric edge of the second portion 15.

The sealed joining between the two portions occurs by means of the application of an adhesive, preferably of the thermoplastic, polyurethane-based or neoprene-based type, or of another equivalent type.

The remaining part of the lower edge 14*a*, related to the central and rear lower part of the foot, is sewn in a tubular manner with the stitched seam 18 in the lower and rear part.

The stitched seam 18 is conveniently waterproofed by means of a waterproof thermal adhesive tape, which upon assembly is exposed to heat and pressed, adhering to the second portion 15 in order to seal it at the stitched seam 18. In this manner a waterproof and breathable upper assembly is provided which wraps around the foot insertion region A, to which the outsole 12 is joined by adhesive bonding or by direct injection on the upper.

Figure 6:
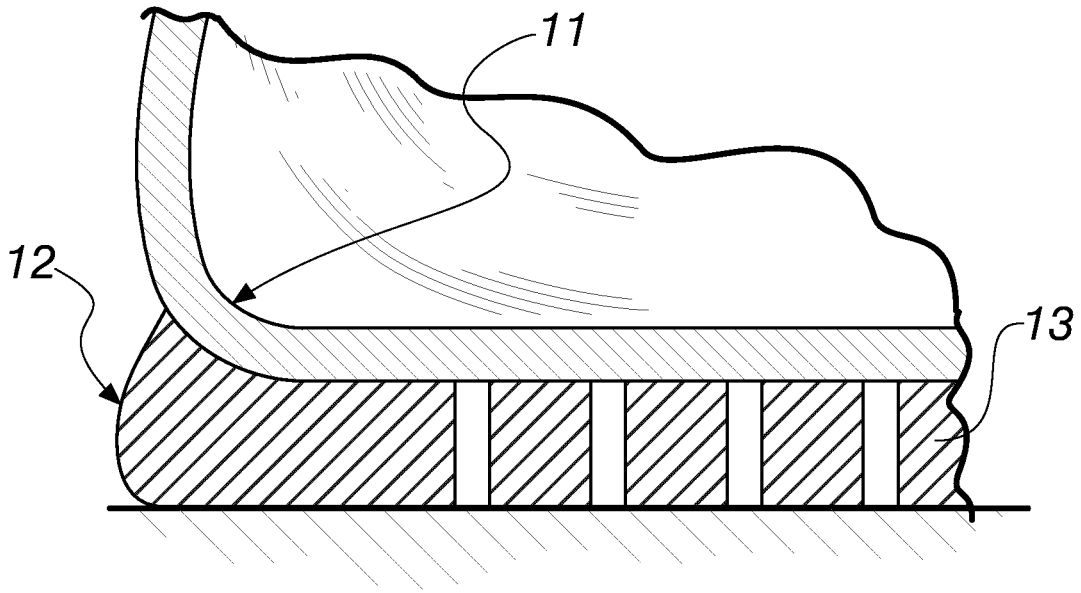
FIGS. 6, 7 and 8 are respectively schematic sectional views of variations of the outsole of a waterproof and breathable shoe according to the invention.
Figure 7:
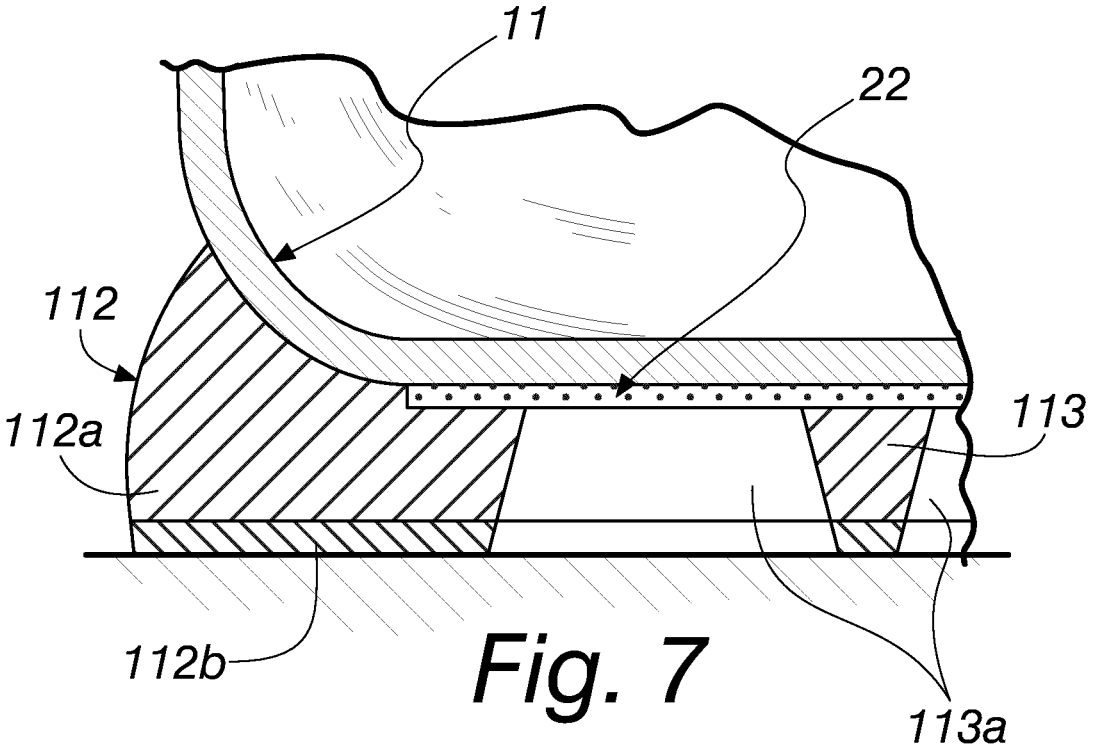
Figure 8:
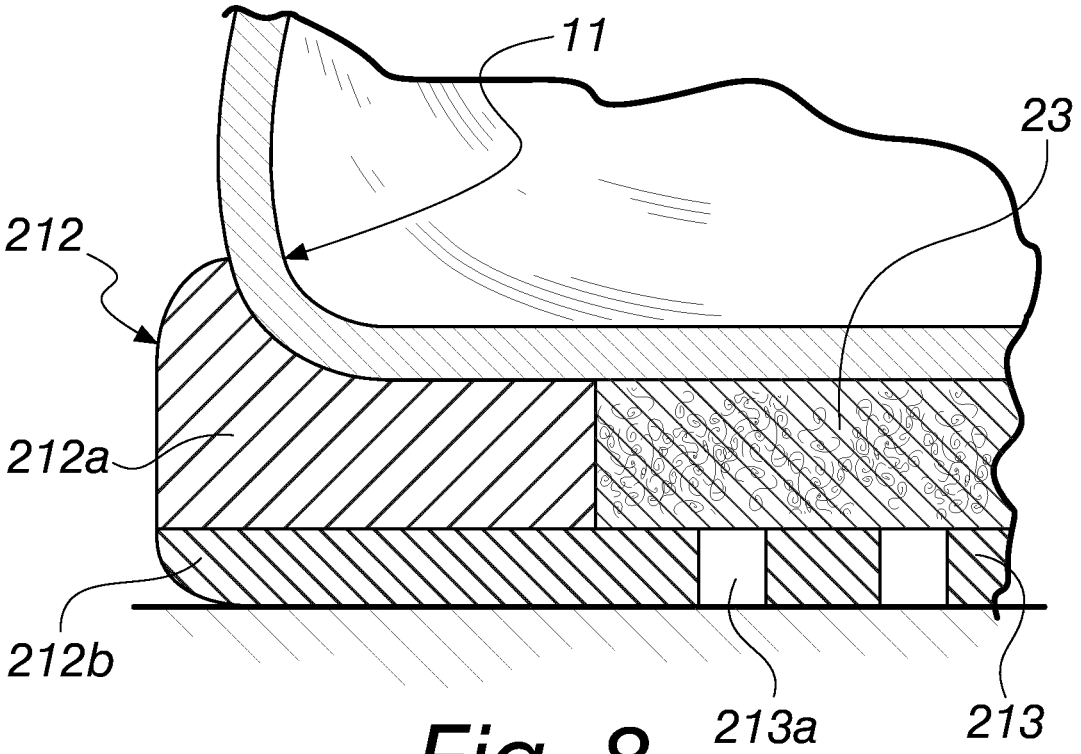

FIGS. 6, 7 and 8 show three variations of outsoles 12, 112 and 212 of the waterproof and breathable shoe 10 according to the invention, associated with an upper assembly 11, which is shown here schematically.

According to a first variation, the outsole 12, which is of the same type shown in the preceding figures, is provided in one piece of polymeric material, preferably vulcanized rubber or thermoplastic material or polyurethane or ethylene vinyl acetate (EVA), and the breathable or perforated portion 13 conveniently has openings 13*a* that pass through the thickness of the outsole 12. As an alternative, such openings can consist of a plurality of through holes.

In the variations shown in FIG. 7 and in FIG. 8, the outsole comprises an upper part and a lower part.

This type is described for the sake of simplicity only with reference to FIG. 7.

As shown, the outsole 112 advantageously comprises an upper part 112*a*, for association with the upper assembly 11, and a lower part 112*b*, provided with a tread, both made of polymeric material.

In particular, the lower part 112*b* is preferably made of vulcanized rubber or thermoplastic material or polyurethane, while the upper part 112*a* is preferably made of ethylene vinyl acetate or expanded polyurethane.

The outsole 12, even if it is provided in a plurality of parts, is joined to the upper assembly 11 for example by adhesive bonding along a band that is perimetric to the second portion 15 and to the lower edge 14*a* of the first portion 14. Since the upper assembly 11 is totally waterproof and breathable, no waterproof sealing joint of the outsole 12 is necessary.

If the functional element constitutes only a portion of the second portion 15 and the breathable or perforated portion 13 has an extension that is limited only to corresponding delimited regions of the outsole 12, the latter is joined to the upper assembly 11 with a seal to the second portion 15 conveniently provided at least perimetrically to the functional element, at the breathable or perforated portion 13. The remaining portions of the second portion 15 are waterproof and not breathable.

As an alternative, the outsole 12 can be provided by direct injection on the upper assembly 11, in one piece or at least its upper part.

In the second outsole variation 112, it is provided with large through openings 113 and conveniently comprises an element 22 for support of the second portion 15, so as to contrast its hollowing at the through openings is 113*a*.

Substantially, the supporting element 22 is interposed between the second portion 15 and the breathable or perforated portion 113 of the outsole 112. It is breathable or perforated and made of a material that is resistant to hydrolysis, preferably chosen among nylon fiber mesh, mesh of fibers made of metallic material, felt, and the like.

In the case of direct injection of the outsole 112 or at least of the upper part 112*a* on the upper assembly 11, the supporting element 22 is conveniently bonded by adhesive at least perimetrically on the second portion 15 prior to the injection of the polymeric material that constitutes the outsole 112. As an alternative, the supporting element 22 can be inserted within the mold for providing the outsole, so that its joining to the upper assembly 11 occurs exclusively by means of the adhesion of the injected polymeric material, without using adhesives.

The third outsole variation 212, shown in FIG. 8, comprises a breathable or diffusely perforated filler element 23 that lies below the functional element of the second portion 15.

In this case also, the outsole 212 is composed of an upper part 212*a* and a lower part 212*b*.

The filler element 23 substantially constitutes a portion of the upper part 212*a* and is adapted to prevent the injection of polymeric material that constitutes the outsole 212 from being able to damage the second portion 15 and therefore the functional element.

It is preferable to use a filler element 23 made of polyester felt. If the filler element is made of a non-breathable material, such as microporous rubber or ethylene vinyl acetate, which are usually used for reasons of comfort and better resilience with respect to felt, this non-breathable material is perforated and it is therefore possible to provide, between the lower part 212*b* and the filler element 23, a barrier element, which is relatively thin and advantageously made of breathable felt or mesh and is adapted to prevent any mud or other substances absorbed during use of the shoe from being able to penetrate and stagnate within the holes of the filler element 23.

Operation of the waterproof and breathable shoe according to the invention is evident from what has been described and illustrated.

In particular it is evident that the waterproof and breathable shoe is capable of obviating the drawbacks of known shoes, since the upper assembly 11 is perfectly waterproof in all of its portions and even in the joining regions thereof, preventing the infiltration of water from outside, despite not preventing vapor permeation and indeed increasing the dissipation of water vapor by way of the larger surface for exchange with the outside.

The waterproof and breathable shoe 10 is in fact capable of ensuring a correct exchange of heat and water vapor between the internal microclimate and the external one both through the outsole and through the upper without thereby compromising its waterproofness and tear resistance.

Furthermore, the waterproof and breathable shoe 10 according to the invention is relatively lightweight, especially if compared to shoes the upper of which is constituted by a number of superimposed layers, since the invention can be provided by means of a single upper layer constituted by the functional element.

The light weight and structural simplicity of the shoe do not compromise its resistance, which is not determined by the presence of a supporting layer that is laminated to the functional element, as often occurs in shoes of the known type, but by the inherent characteristics of the functional element used here.

It has in fact been demonstrated that this type of functional element, characterized by the previously indicated particular thickness, has characteristics of penetration resistance, abrasion resistance, tensile strength, tear strength, waterproofness and permeability to water vapor that make it particularly suitable for the provision of waterproof and breathable shoes that are resistant, both during the assembly of the shoe, for the stresses to which it is subjected during lasting, and during use of such shoes.

The tensile strength values achieved by the functional element, which are high with respect to the ones obtained with the thin films that are present in the background art, make it capable of constituting the structural layer of the upper. The term "structural" is understood as the ability to withstand the tensile stresses and tear stresses that are generated during the working and assembly of the upper (for example the operation for assembling the edge 14*a* below the second portion 15, which must be performed with a machine known as toe lasting machine or manually with adapted tools that are used to pull and stretch the edge 14*a* under the perimetric edge). Thanks to the tensile strength and the tear strength of the functional element, the first portion 14 has an adequate resistance to the stress induced by the assembly clamps.

The shoe, besides being comfortable to use due to its total waterproofness and breathability and also due to its light weight, can be manufactured with relatively low costs.

It should be noted that several advantages are achieved also by way of the outsole variations described.

In the case of a outsole 112 provided with a supporting element 22, the shoe can be rendered even lighter by increasing the size of the through openings 113*a* and thus reducing the mass of polymeric material that composes it. The supporting element 22 is in fact conveniently arranged at the through openings 113*a*, so as to contrast, during the use of the shoe, the hollowing of the second portion 15 in the through openings 113*a*.

The filler element 23 of the outsole 212 is useful to prevent the injection of the polymeric material that constitutes the outsole from being able to damage the functional element of the second portion 15, inhibiting its breathability.

Furthermore, the use of the filler element allows to keep the functional element spaced from the tread of the outsole, so as to preserve it against any pointed foreign objects that might damage it by entering the outsole through the through openings, and also allowing the molecules of water vapor produced by sweating to exit over the entire surface and not only at the through openings of the outsole.

Usually, the use of the filler element is particularly advantageous in outsoles of considerable thickness, since it allows to reduce the depth of the channels that provide the holes or the through openings through the lower part of the outsole, preventing such channels from retaining therein foreign objects that might enter them.

Furthermore, containing the depth of such channels allows to limit the height of the pins that protrude from the mold of the outsole and are suitable to form its holes. In this manner the molded outsole is easier to be extracted from the mold and the pins are subjected to lower stresses, with a consequent lower risk of breakage thereof.

Another advantage resides in that the use of the filler element allows to obtain a shoe that as a whole is even lighter, since such filler has a lower weight than the polymeric material of the portion of outsole that it replaces.

In practice it has been found that the invention achieves the intended aim and objects, providing a shoe that is more effectively waterproof and breathable with respect to currently known shoes, having these characteristics substantially over its entire structure, which at the same time is lighter and simpler, though being equally strong.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. 102015000041242 (UB2015A002773) from which this application claims priority are incorporated herein by reference.

The invention claimed is:

1. A waterproof and breathable shoe comprising:

an upper assembly that wraps around a foot insertion region and is associated, in a plantar region thereof, with an outsole, wherein:

said upper assembly has a first portion and a second portion, the first portion forming an upper, and the second portion forming an assembly insole for said first portion of the upper assembly and is extended at least at the forefoot, said first portion of the upper assembly has at least one waterproof portion that is composed at least partly of a first waterproof and breathable functional element that has a one piece sheet structure made of polymeric material that is impermeable to water and permeable to water vapor, at least one functional portion of said first functional element has a thickness between 0.1 mm and 3 mm and has a penetration resistance greater than 10 N, and the at least one functional portion constitutes a structural layer of the upper.

2. The waterproof and breathable shoe according to claim 1, wherein said outsole has at least one breathable or perforated portion and said second portion of the upper assembly has at least one waterproof portion that is composed at least partly of a second waterproof and breathable functional element that has a one piece sheet structure made of polymeric material that is impermeable to water and permeable to water vapor, at least one functional portion of said second functional element having such a thickness so as to give the functional portion a penetration resistance greater than 10 N, assessed according to the methodology presented in chapter 5.8.2 of the ISO 20344-2004 standard, said functional portion covering said at least one breathable or perforated portion of said outsole and said first portion of the upper assembly and said second portion of the upper assembly being sealed in a waterproof manner.

3. The waterproof and breathable shoe according to claim 1, wherein at least one functional portion of said first functional element has a tensile strength of greater than 20 MPa, assessed according to the methodology presented in the EN12803:2000 standard.

4. The waterproof and breathable shoe according to claim 1, wherein at least one functional portion of said first functional element has a tear strength at least equal to 10 N, determined according to the methodology presented in the EN13571:2001 standard.

5. The waterproof and breathable shoe according to claim 1, wherein said first portion of the upper assembly comprises an external mesh that constitutes the outer layer of the upper.

6. The waterproof and breathable shoe according to claim 1, wherein said one piece sheet structure is stratified and cohesive, comprising a plurality of functional layers made of polymeric material that are impermeable to water in the liquid state and permeable to water vapor.

7. The waterproof and breathable shoe according to claim 1, wherein said first portion is coupled to a breathable upper lining, which is arranged so as to line said first portion of the upper assembly inside the foot insertion region so as to form an upper assembly of said waterproof and breathable shoe.

8. The waterproof and breathable shoe according to claim 7, wherein a lower edge of the first portion of the upper assembly protrudes from a lower flap of said upper lining, producing an assembly margin that is folded below said second portion of the upper assembly.

9. The waterproof and breathable shoe according to claim 7, wherein said upper lining is bonded by spot gluing and/or stitches to said first portion of the upper assembly.

10. The waterproof and breathable shoe according to claim 2, wherein said second portion of the upper assembly is entirely constituted by said second functional element.

11. The waterproof and breathable shoe according to claim 2, wherein said second portion of the upper assembly is coupled to a breathable or perforated reinforcement layer, which covers a face thereof directed toward the foot insertion region so as to form a lower assembly of said waterproof and breathable shoe.

12. The waterproof and breathable shoe according to claim 1, wherein said first portion of the upper assembly, is joined perimetrically to said second portion of the upper assembly, with a lower edge thereof, the latter being folded and glued so as to form a seal according to the construction known as "AGO lasting", below the perimetric edge of said second portion of the upper assembly.

13. The waterproof and breathable shoe according to claim 12, wherein a remaining part of said lower edge is sewn in a tubular manner in the lower and rear central part.

14. The waterproof and breathable shoe according to claim 1, wherein said first portion is associated at an end thereof by means of a stitched seam of the strobel type with the perimetric edge of said second portion of the upper assembly.

15. The waterproof and breathable shoe according to claim 1, wherein said outsole comprises at least one breathable or diffusely perforated filler element that lies below said functional element of said second portion of the upper assembly.

* * * * *